US006073899A

United States Patent [19]

Omrani

[11] Patent Number: 6,073,899

[45] Date of Patent: Jun. 13, 2000

[54] UNIVERSAL TISSUE BOX HANGER

[76] Inventor: Shahram Shawn Omrani, 11 Idaho St., Passaic, N.J. 07055-3336

[21] Appl. No.: 09/135,788

[22] Filed: Aug. 18, 1998

[51] Int. Cl.[7] ..... A47K 1/08

[52] U.S. Cl. ..... 248/311.2; 248/316.4; 248/316.7; 248/905

[58] Field of Search ..... 248/311.2, 214, 248/300, 316.4, 905, 316.7; 52/98, 100

[56] References Cited

U.S. PATENT DOCUMENTS

| | | | |
|---|---|---|---|
| 2,263,956 | 11/1941 | Russell | 248/311 |
| 2,673,056 | 3/1954 | Manetti | 248/311 |
| 2,889,016 | 6/1959 | Warren | 52/98 |
| 2,920,853 | 1/1960 | Bufogle | 248/214 |
| 3,089,597 | 5/1963 | Kaplan | 211/88 |
| 3,168,275 | 2/1965 | Grondin | 248/205 |
| 3,177,048 | 4/1965 | Whatley | 312/351 |
| 3,258,238 | 6/1966 | Grafton | 248/311 |
| 3,917,207 | 11/1975 | Quigley | 248/311 |
| 3,944,809 | 3/1976 | Moore et al. | 248/300 |
| 4,332,060 | 6/1982 | Sato | 21/67.9 |
| 4,691,396 | 9/1987 | Hoffman | 248/205.1 |
| 4,696,448 | 9/1987 | Mazloom et al. | 248/311.2 |
| 5,134,822 | 8/1992 | Edlin | 52/273 |
| 5,157,881 | 10/1992 | Tashman et al. | 52/98 |
| 5,398,856 | 3/1995 | Shyu | 248/311.3 |
| 5,624,095 | 4/1997 | Zissu | 248/300 |
| 5,681,019 | 10/1997 | Boyce | 248/229.11 |
| 5,903,869 | 5/1999 | Jacobson et al. | 248/205.3 |

*Primary Examiner*—Anita M. King
*Assistant Examiner*—Debbie Short
*Attorney, Agent, or Firm*—Terrance L. Siemens

[57] ABSTRACT

A hanger for suspending a parallelepiped, such as a box for storing and dispensing tissue papers from furniture having a graspable element, such as the headboard of a bed. The hanger is generally "Z" shaped, having a central strap member, a first hook located at the top of the central strap member, for compressively entrapping the headboard, and a second hook located at the bottom of the central strap member, for compressively entrapping the box of tissue papers. The two hooks project in opposite directions from the central strap member. The second hook is adjustable in width to accommodate boxes of different capacities and dimensions. Each hook comprises two flat strap sections arranged at acute angles to one another. The constituent material of the hanger is elastic, so that the hooks can be spread open and will be spontaneously urged to close. A score line is formed between the first hook and the central strap member, so that the former may be broken off to enable the central strap member to be attached to a broad, vertical environmental surface by threaded fasteners. The novel hanger is preferably employed in pairs, one supporting each side of a tissue dispensing box.

12 Claims, 2 Drawing Sheets

UNIVERSAL TISSUE BOX HANGER

BACKGROUND OF THE INVENTION

1. Field of the Invention

The present invention relates to a hanger for suspending a parallelepiped from furniture having a graspable element. More particularly, the invention is a holder capable of compressively grasping the headboard or other portion of the frame of a bed, and compressively grasping a box for dispensing tissue paper. The former is only one representative application of the invention, which may be employed to support a carton or other container at a convenient height for dispensing its contents.

2. Description of the Prior Art

Bedridden patients afflicted with nasal congestion and similar conditions must frequently clear their nasal passages with tissue papers provided for that purpose. Since the need may arise suddenly, it is desirable to maintain a supply of tissue papers enclosed in a conventional dispensing box close by. One convenient location for the box is suspended from the headboard of the bed. In this location, the box is easily in reach, yet does not risk becoming entrapped in bedclothes or the like, nor being crushed when the patient moves about. To suspend a conventional tissue supply and dispensing box requires a support which can grasp and retain both the box and a member of the headboard or frame.

Hooks and brackets adapted to hold articles near environmental surfaces are old. Examples having a hook at each end, one for engaging a supporting environmental member and one for grasping the subject article, are seen in U.S. Pat. No. 5,489,078, issued to Nathaniel H. Risley on Feb. 6, 1996, U.S. Pat. No. 5,553,823, issued to William F. Protz, Jr., on Sep. 10, 1996, and U.S. Pat. No. 5,738,319, issued to Walter L. Grassi on Apr. 14, 1998. Risley's clip lacks adjustment in length of one hook, as seen in the present invention. Also, the other hook of Risley is curved, thereby not being configured to conform to a parallelepiped. The wreath hanger of Protz, Jr. also lacks adjustability of length of a hook. Also, one hook is curved, rather than configured to conform to a parallelepiped. Grassi's device has square, adjustable length hooks, but lacks inward inclination and elastic resilience of material enabling a hook to compressively engage the supporting environmental member and the article being supported.

A door hook which spans the thickness of a door is shown in U.S. Pat. No. 5,607,131, issued to William E. Adams on Mar. 4, 1997. This device has two individual hooks disposed upon the same side of a central member, thereby forming a squared "C" shape, rather than the squared "Z" shape of the present invention. Also, the two individual hooks are curved, rather than squared, as is seen in the present invention. Adjustment in Adams enables the hook to be located closer or farther from the central member, but does not affect dimensions of the hook itself, as seen in the present invention.

In addition to deviations from the present invention set forth above, none of these prior art devices has a scoring line enabling one hook section to be broken off at a predetermined point to enable the device to be bolted to a vertical surface rather than engage the top and rear surfaces of the supporting environmental element. This feature is novel to the present invention.

None of the above inventions and patents, taken either singly or in combination, is seen to describe the instant invention as claimed.

SUMMARY OF THE INVENTION

The present invention provides a universal hanger suitable for securing a box or other parallelepiped to an environmental object, such as a headboard of a bed. The hanger is employed to secure a supply of useful articles, such as tissue papers, within easy reach of the occupant of the bed. This is particularly useful to bedridden patients afflicted with nasal congestion and similar conditions. The hanger comprises two hooks mounted to a common connecting member. One hook hangs from the top surface of the headboard, and the other hook closes over and grasps the box.

Both structure of beds and boxes or cartons of tissue paper vary in dimensions and configuration. Therefore, in order to enjoy widespread effectiveness, the hanger must accommodate these differences in dimensions and configuration. To this end, the hook which engages a box is adjustable as to dimensions of the size of the opening. Both hooks are mildly resilient, and spontaneously close if manually spread open.

The upper hook, that being the hook which engages the headboard, bears a score or the like which enables it to be broken away from the rest of the hanger. This enables the hanger to be fastened to a broad, flat surface by fasteners passed through holes formed to accept the same. The hanger is thus rendered readily convertible from hook mounting to a bed to being suitable for flush mounting.

Preferably, the novel hanger is employed in pairs, one disposed on each side of a tissue box. Each individual hanger need not be of great width, since with two hangers, each supports one side of the tissue box. The novel hanger is therefore universally usable with many different boxes which are commercially available. Different thickness of different boxes is accommodated by adjusting width of the hooks, while different box lengths are accommodated by spacing apart the two hooks appropriately.

Accordingly, it is a one object of the invention to provide a hanger for suspending a box in easy reach of a person occupying a bed.

It is another object of the invention that the hanger be adjustable to accommodate boxes of different dimensions.

It is a further object of the invention that the hanger be readily convertible for flush mounting by fasteners.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
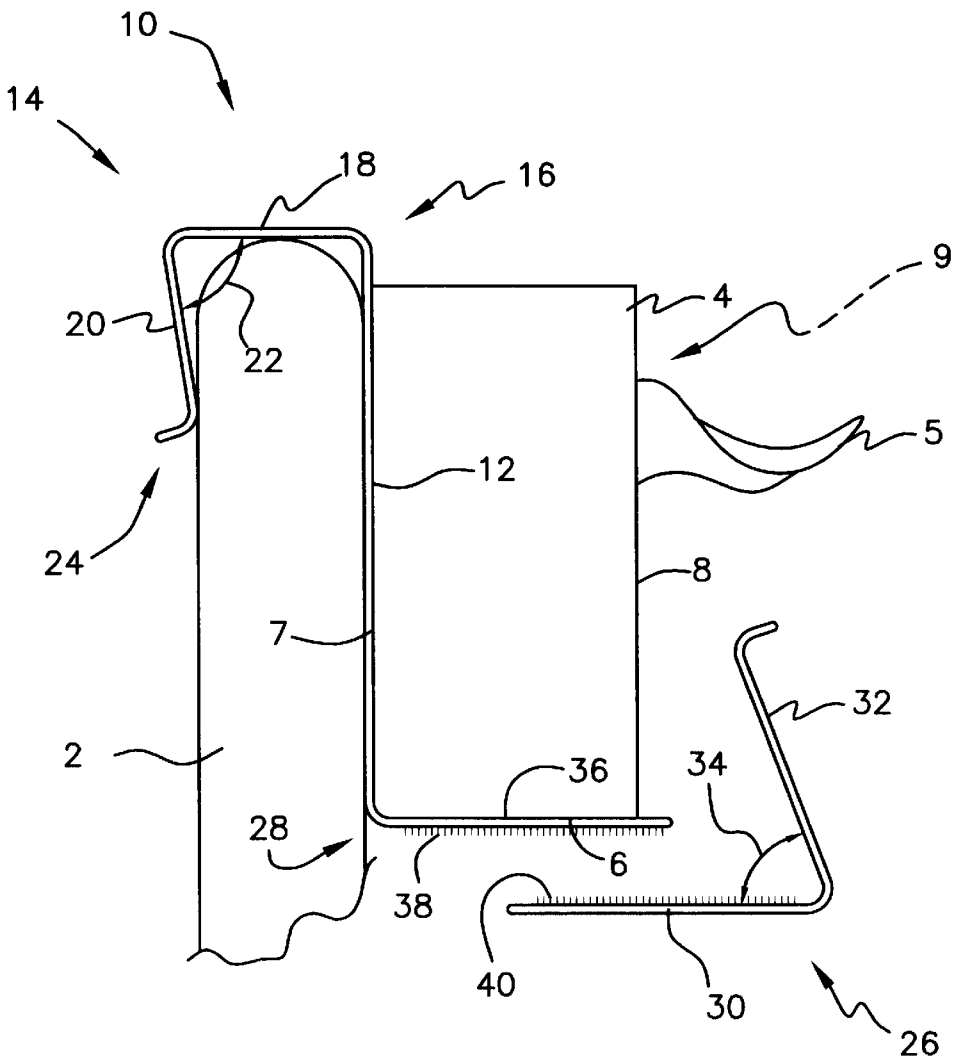
FIG. 1 is an exploded, environmental, side elevational view of the invention, with environmental elements shown in broken lines.

Turning now to FIG. 1 of the drawings, universal hanger 10 is shown compressively entrapping a headboard 2 of a bed (not shown in its entirety). Hanger 10 is supported by headboard 2 and in turn supports a box 4 of tissues which an occupant of the bed desires to have close at hand. Box 4 is a conventional box for containing and dispensing tissues 5, having a planar bottom surface 6, a planar rear surface 7, and a front surface 8 bearing a slot 9 for dispensing tissues 5.

Hanger 10 comprises a central member 12 comprising essentially a flat strap which is normally vertically disposed when hanger 10 is attached to headboard 2. For semantic clarity, that side of central member 12 which faces headboard 2 will be called the rear side, and that side facing box 4 will be called the front side.

A first hook 14 projects rearwardly, or from the rear side, from proximal end 16 of central member 12. First hook 14 comprises a flat strap section 18 which abuts and projects from central member 12, and a second flat strap section 20 which projects from strap section 18, forming an acute angle 22 between sections 18, 20. Section 18 has a flared portion, indicated at 24, opening away from central member 12 so that hook 14 is readily slipped over headboard 2. Preferably, all principal sections of hanger 10 are fabricated from a mildly resilient material, such as synthetic resins, which deflect when section 20 is pulled or spread open, thereby increasing magnitude of angle 22, and which will resiliently and spontaneously close when section 20 is released.

A second hook 26 projects forwardly, or from the front side, from central member side at its distal end 28. Second hook 26 comprises a first flat strap section 30 projecting from central member 12 and a second flat strap section 32 forming an acute angle 34 with respect to first section 30. Central member 12 includes a projection 36 fixed thereto at distal end 28, which projects to the front side of central member 12. First section 30 of hook 26 overlaps projection 36 and engages projection 36 adjustably along a significant portion of the length of projection 36.

Engagement of first section 30 and projection 36 may be accomplished in any suitable manner which enables adjustment of the effective length of first section 30. In the embodiment of FIG. 1, complementary patches 38, 40 of hook and loop fastening material disposed upon projection 36 and on first section 30. Hook 26 is, of course, also fabricated from a resilient material which deflects when second flat strap section 32 of hook 26 is spread open, and resiliently closes when released.

Figure 2:
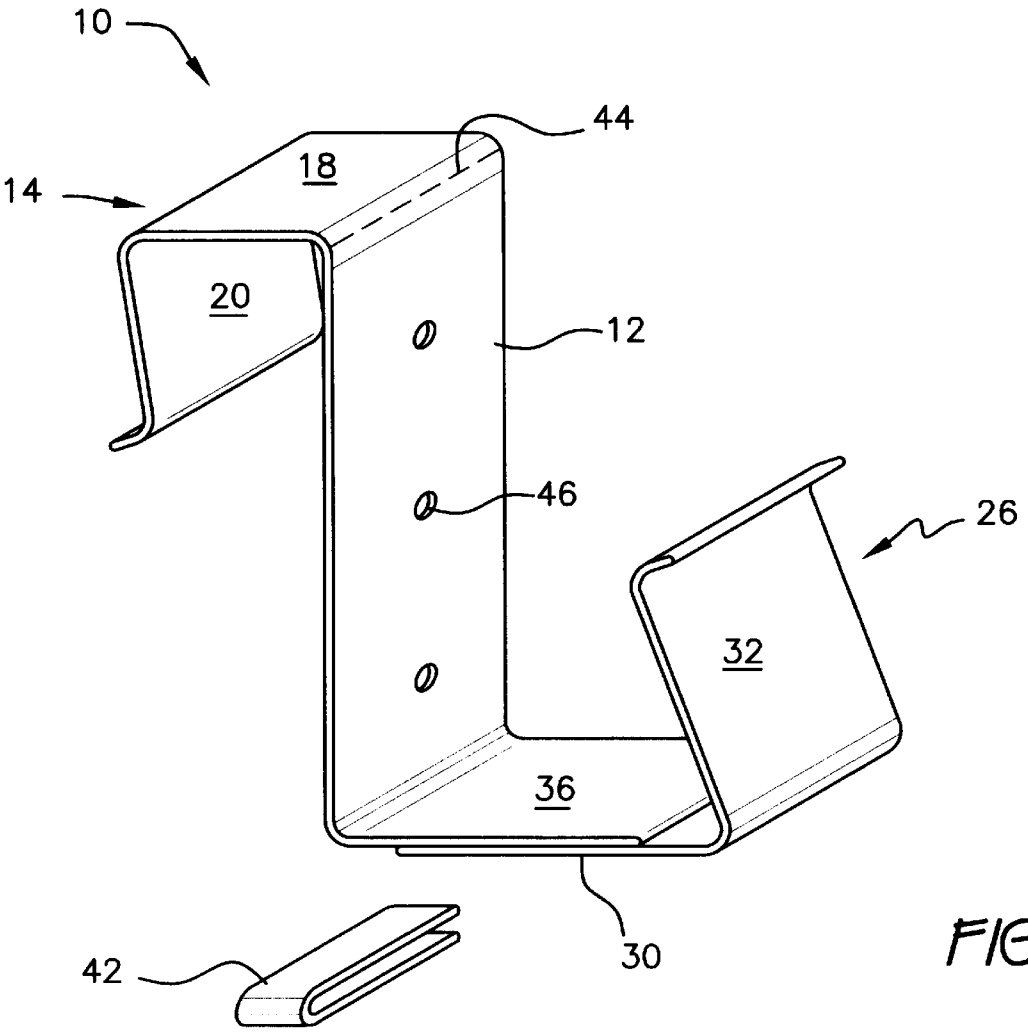
FIG. 2 is a perspective view of an alternative embodiment of the invention.

FIG. 2 illustrates a second embodiment of the invention, wherein section 30 of hook 26 is retained to projection 36 by a clip 42 which is dimensioned and configured to pinch second hook 26 into engagement with central member 12. Clip 42 is slid laterally over both section 30 and projection 36 prior to placing box 4 in hook 26.

Another feature of the invention is that hanger 10 is readily converted from depending upon engagement of the top of headboard 2 by hook 14 to being flush mounted to a flat environmental surface (not shown). A frangible score 44 is formed between central member 12 and first hook 14 where section 18 meets central member 12. Score 44 may comprise a continuous score, a succession of holes or depressions, or any other modification to hanger 10 which would weaken hanger 10 along the line indicated at 44, so that hook 14 may be broken manually from the balance of hanger 10. Holes 46 passing entirely through central member 12 from the front side to the rear side will accept fasteners such as screws or nails which may be employed to fasten hanger 10 to the environmental surface.

It is to be understood that the present invention is not limited to the embodiments described above, but encompasses any and all embodiments within the scope of the following claims.

I claim:

1. A universal hanger for compressively entrapping an environmental support element and an article to be supported, comprising:

a central member having a front side, a rear side, a proximal end, and a distal end;

a first hook projecting rearwardly from said proximal end at said rear side;

a second hook projecting forwardly from said distal end at said front side, wherein said central member comprises a flat strap and said second hook comprises a first flat strap section projecting from said central member and a second flat strap section forming an acute angle with respect to said first flat strap section, wherein said second hook is fabricated from a resilient material which deflects when said second flat strap section is spread open and is resiliently urged to close when said flat strap section is spread open; and a frangible score formed between said central member and said first hook, wherein said frangible score is disposed to enable said first hook to be broken away from said central member and from said second hook, wherein said universal hanger has a fastener disposed to removably and adjustable attach said second hook to said central member.

2. The universal hanger according to claim 1, wherein said central member comprises a flat strap and said first hook comprises a first flat strap section projecting from said central member and a second flat strap section forming an acute angle with respect to said first flat strap section, wherein said first hook is fabricated from a resilient material which deflects when said second flat strap section is spread open and is resiliently urged to close when said flat strap section is spread open.

3. The universal hanger according to claim 2, wherein said second flat strap section has a flared portion opening away from said central member.

4. The universal hanger according to claim 1, wherein said central member includes a projection fixed to said distal end of said central member and projecting towards said front side of said central member, and said first flat strap section of said second hook is dimensioned and configured to overlap said projection and to engage said projection adjustably along the length of said projection.

5. The universal hanger according to claim 1, wherein said fastener includes complementary patches of hook and loop fastening material disposed upon said central member and said second hook.

6. The universal hanger according to claim 1, wherein said fastener comprises a clip dimensioned and configured to pinch said second hook into engagement with said central member.

7. The universal hanger according to claim 1, wherein said central member has holes passing entirely therethrough from said front side to said rear side, for accepting fasteners.

8. A universal hanger for compressively entrapping an environmental support element and an article to be supported, comprising:

a central member comprising a flat strap having a front side, a rear side, a proximal end, a distal end, and a projection projecting from said distal end, and said central member has a frangible score formed between said central member and said first hook and holes passing entirely through said central member from said front side to said rear side, for accepting fasteners;

a first hook projecting rearwardly from said proximal end at said rear side, said first hook comprising a first flat strap section projecting from said central member and a second flat strap section forming an acute angle with respect to said first flat strap section, said second flat strap section having a flared portion opening away from said central member; and a second hook projecting forwardly from said distal end at said front side, said second hook comprising a first flat strap section projecting from said central member and a second flat strap section forming an acute angle with respect to said first flat strap section of said second hook, said second hook having a releasable manual fastener disposed to secure said second hook adjustably to said projection of said central member, wherein said first hook and said second hook are fabricated from a resilient material which deflects when manually bent and is resiliently urged to close when released.

9. The universal hanger according to claim 8, wherein said releasable manual fastener comprises complementary patches of hook and loop fastening material disposed upon said central member and said second hook.

10. The universal hanger according to claim 8, wherein said releasable manual fastener comprises a clip dimensioned and configured to pinch said second hook into engagement with said central member.

11. A universal hanger for compressively entrapping an environmental support element and an article to be supported, comprising:

a central member comprising a flat strap having a front side, a rear side, a proximal end, a distal end, and a projection projecting from said distal end;

a first hook projecting rearwardly from said proximal end at said rear side, said first hook comprising a first flat strap section projecting from said central member and a second flat strap section forming an acute angle with respect to said first flat strap section, said second flat strap section having a flared portion opening away from said central member; and a second hook projecting forwardly from said distal end at said front side, said second hook comprising a first flat strap section separate from and projecting from said central member and a second flat strap section joined to said first flat strap section, said second flat strap section forming an acute angle with respect to said first flat strap section of said second hook, said universal hanger having hook and loop fastening material disposed upon said first flat strap section of said second hook, and said projection of said central member having a complementary patch of hook and loop material disposed thereon in a location enabling said first flat strap section of said second hook to engage and be removably secured to said projection of said central member, wherein said first hook and said second hook are fabricated from a resilient material which deflects when manually bent and is resiliently urged to close when released, wherein said central member has a frangible score formed between said central member and said first hook and holes passing entirely through said central member from said front side to said rear side, for accepting fasteners.

12. A box adapted to be suspended selectively by hanging over a vertically projecting ledge and by fastening to a vertical surface, comprising:

a tissue box having a planar bottom surface, a planar rear surface, and a front surface bearing a slot; and two universal hangers each comprising a central member comprising a flat strap having a front side, a rear side, a proximal end, a distal end, and a projection projecting from said distal end, a first hook projecting rearwardly from said proximal end at said rear side, said first hook comprising a first flat strap section projecting from said central member and a second flat strap section forming an acute angle with respect to said first flat strap section, said second flat strap section having a flared portion opening away from said central member, and a second hook projecting forwardly from said distal end at said front side, said second hook comprising a first flat strap section projecting from said central member and a second flat strap section forming an acute angle with respect to said first flat strap section of said second hook, said second hook having complementary patches of hook and loop fastening material disposed upon said central member and said second hook, wherein said first hook and said second hook are fabricated from a resilient material which deflects when manually bent and is resiliently urged to close when released, wherein said central member has a frangible score formed between said central member and said first hook and holes passing entirely through said central member from said front side to said rear side, for accepting fasteners.

* * * * *